US007673825B2

(12) United States Patent
Jeansonne et al.

(10) Patent No.: US 7,673,825 B2
(45) Date of Patent: Mar. 9, 2010

(54) MACHINE FOR SHREDDING/COLLECTING DRUGS AND DRUG PACKAGING INCIDENT TO PERMANENT DISPOSAL

(76) Inventors: Gordon Bud Jeansonne, 135 N. Madison St., Orange, VA (US) 22960; Maureen Gallagher, 135 N. Madison St., Orange, VA (US) 22960

( * ) Notice: Subject to any disclaimer, the term of this patent is extended or adjusted under 35 U.S.C. 154(b) by 239 days.

(21) Appl. No.: 11/715,414

(22) Filed: Mar. 8, 2007

(65) Prior Publication Data

US 2008/0217447 A1 Sep. 11, 2008

(51) Int. Cl.
*B02C 23/00* (2006.01)
*B02C 1/10* (2006.01)

(52) U.S. Cl. ..... 241/100; 241/101.2; 241/606

(58) Field of Classification Search ..... 241/100, 241/101.2, 606, DIG. 38, 99
See application file for complete search history.

(56) References Cited

U.S. PATENT DOCUMENTS

| | | | | |
|---|---|---|---|---|
| 3,389,864 | A | 6/1968 | Topinka | |
| 3,404,593 | A * | 10/1968 | Arcarese et al. | 83/167 |
| 3,682,402 | A | 8/1972 | Goldhammer | |
| 3,750,966 | A | 8/1973 | Anderson | |
| 4,531,437 | A * | 7/1985 | Szablak et al. | 83/165 |
| 4,873,811 | A | 10/1989 | Izumitani | |
| 5,035,367 | A | 7/1991 | Nojima | |
| 5,165,564 | A | 11/1992 | Prout et al. | |
| 5,226,606 | A * | 7/1993 | Jasperson et al. | 241/99 |
| 5,282,428 | A | 2/1994 | Greville et al. | |
| 5,375,781 | A | 12/1994 | Schwelling | |
| 5,429,313 | A | 7/1995 | Schwelling | |
| 5,590,840 | A | 1/1997 | Adams et al. | |
| 5,662,281 | A | 9/1997 | Wollert et al. | |
| 5,692,687 | A | 12/1997 | Kateley | |
| 5,887,807 | A | 3/1999 | Bienicke | |
| 5,897,065 | A | 4/1999 | Schwelling | |
| 6,186,428 | B1 | 2/2001 | Robinson et al. | |
| 6,568,614 | B2 | 5/2003 | Chen et al. | |
| 7,204,441 | B1 * | 4/2007 | Hartnett et al. | 241/100 |
| 2006/0054725 | A1 | 3/2006 | Matlin | |
| 2006/0086847 | A1 | 4/2006 | Schenker | |
| 2006/0091247 | A1 | 5/2006 | Matlin | |

* cited by examiner

*Primary Examiner*—Faye Francis
(74) *Attorney, Agent, or Firm*—Miles & Stockbridge P.C.; David R. Schaffer, Esq.

(57) ABSTRACT

A drug and/or drug packaging shredding/collecting machine includes a cabinet defining an interior chamber which can be accessed through a front opening for housing and storing a container lid and container incident to the shredding of drugs and drug packaging by a shredder carried by a top wall of the cabinet. The top wall also includes a non-shredable drug/drug packaging opening which includes a flexible inlet guard. A door of the container includes a storage area for plastic locking ties which, after the lid is slid to a nested position with respect to a channel/flange of the container can lock the two together through registered openings thereof thereby preventing inadvertent/accidental spillage and/or providing an indication of pilfering.

18 Claims, 3 Drawing Sheets

MACHINE FOR SHREDDING/COLLECTING DRUGS AND DRUG PACKAGING INCIDENT TO PERMANENT DISPOSAL

BACKGROUND OF THE INVENTION

The invention is directed to a wheeled machine for shredding and/or collecting drugs and similar pharmaceutical and/or medical products incident to permanent disposal which can be utilized in hospitals, pharmacies, nursing homes or like medical facilities by nurses or similar healthcare providers.

By law, expired drugs, prescriptions, over-the-counter medications, etc. must be destroyed to prevent unauthorized distribution which could lead to serious medical problems, as well as providing the added benefit of reducing the possibility that they may be diverted or use in drug counterfeiting/trafficking. Typical drugs and their packaging include tablets, capsules, granules, and liquids utilized in conjunction with any one of associated pill bottles, caps, tubes, vials, ampules, blister packages, blister cards, blister packs, multiple unit packages, twin blister packs, unit dosing packages and the like.

A typical conventional drug depository is, for example, a drop chute collection unit manufactured and sold by deVault Company, Inc. which is illustrated and described at http://deVault.com/drop_chute.html. Model No. DVDC0060 disclosed thereat is 19"W×42"H×19"D and includes a simple "drop and go" deposit slot through which disposed drugs and/or packaging are guided by a funnel system into removable totes for safe and easy collection with access being provided via a front key-lock access door.

Mobile or portable units specifically designed for shedding, crushing and collecting medical waste products and material are disclosed in U.S. Pat. No. 5,590,804 issued on Jan. 7, 1997 to Mathew J. Adams et al. and U.S. Pat. No. 6,568,614 B2 issued on May 27, 2003 to Han Jong Chen et al. while two other shredders utilized for more general purpose shredding are disclosed in Pub. No.: US 2006/0091247 A1 in the name of Tai Hoon Kim Matlin published on May 4, 2006 and Pub. No. US 2006/0086874 A1 in the name of David A. Schenker published on Apr. 27, 2006. The latter patents and publications reflect the most relevant prior art found during a search of the present invention which also included the below-listed additional publication and patents:

| | |
|---|---|
| U.S. 2006/0054725 | Matlin |
| 3,389,864 | Topinka |
| 3,682,402 | Goldhammer |
| 3,750,966 | Anderson |
| 4,531,437 | Szablak et al. |
| 4,873,811 | Izumintani |
| 5,035,367 | Nojima |
| 5,165,564 | Prout et al. |
| 5,282,428 | Greville et al. |
| 5,375,781 | Schwelling |
| 5,429,313 | Schwelling |
| 5,662,281 | Wollert et al. |
| 5,692,687 | Kateley |
| 5,887,807 | Bienicke |
| 5,897,065 | Schwelling |
| 6,186,428 | Robinson et al. |

Recently the Institute of Medicine (IOM) recommended more unit-dose packaging and clear copy on product labels, recommendations that Mr. Peter Maybery, executive director of the Healthcare Compliance Counsel, called "pure gold." The IOM report has set off a debate both within the industry and in Washington, D.C. as to whether drug manufacturers are moving quickly enough into blister packs, though there is not any federal requirement of any kind that they do so. Drug companies already put certain products in unit-dose packaging and unit-of-use packaging and the latter is expected to increase even though the Food and Drug Administration (FDA) has made no specific requirements with respect to such packaging other than the drug bar coding requirement that went into effect April of 2006. It required all manufacturers, whether they sell direct to hospitals or through wholesalers, to make sure that each drug container which ends up in a hospital pharmacy has a linear bar code which, at a minimum, contains the drugs' National Drug Code (NDC) number, a requirement that grew out of a 1989 IOM report that estimated there are 98,000 deaths annually from medication errors. Though the FDA rules do not require that hospital SKUs be packaged in a unit-of-use or unit-dose package, most pharmaceutical companies are beginning to do just that. Therefore, in the coming years an effective drug shredding/collecting system for effectively destroying expired drugs must necessarily have the capability of disposing of all drugs and drug packaging, be such small plastic bottles and caps, larger bulk bottles utilized by retail pharmacies or the ever expanding unit-of-use and unit-dose packaging (blister packs) which in the United States now stands at only 20% as compared to 80% overseas. Accordingly, at this point in time hospitals, hospital pharmacies, retail pharmacies, etc. require a machine which can both shred and collect drug and drug packaging of virtually any type, particularly being mindful of the ever expanding unit-of-use and unit-dose use blister packaging.

No matter the particular type drug and drug package collection unit utilized by hospitals, pharmacies or the like, the destruction of expired drugs is subject to strict accountability. For example, pills or capsules which are destroyed in a hospital environment must be removed from the container, blister pack or the like and crushed in the presence of two persons, generally nurses. Obviously, removing individual pills/capsules from a multiple dose blister pack before crushing the same is work intense and wasteful of the expertise and healthcare efforts of nurses whether in hospitals, nursing homes, rehabilitation centers or other healthcare facilities. Accordingly, the healthcare industry as a whole requires that which to date has not been provided, namely, a drug shredding machine which can efficiently, safely and with a high degree of accountability heretofore unprovided in the industry shred/collect drugs and drug packaging with unparallel security and the prevention of theft, black marketing, resale, pirating, reuse, pilferage, shrinkage and dumpster diving with respect to expired/tainted or otherwise unuseful drugs.

BRIEF SUMMARY OF THE INVENTION

In keeping with the foregoing, a primary object of the present invention is to provide a novel portable machine for shredding and collecting drugs and drug packaging in virtually any healthcare environment incident to being thereafter transported to and destroyed at large commercial pharmaceutical material destruction centers normally used by drug companies, distributors or wholesalers. The shredding/collecting machine of the present invention includes a cabinet with a top wall supporting a shredder for drugs and drug packaging and an opening for non-shredable drug packages, such as plastic bottles and caps, which are deposited in a collection container within an interior chamber of the machine which is also accessed through a front opening normally closed by a lockable pivotably mounted front door. The non-shredable drug/drug packaging opening includes a flexible inlet guard separated radially into a plurality of triangular flaps to limit access into the interior chamber of the cabinet/housing. The interior housing includes a storage area for a container lid and a storage area for plastic locking ties which when the lid is slid to a nested position with respect to a flange of the collection container can lock the two together thereby preventing inadvertent/accidental spillage and/or indicate pilfering.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
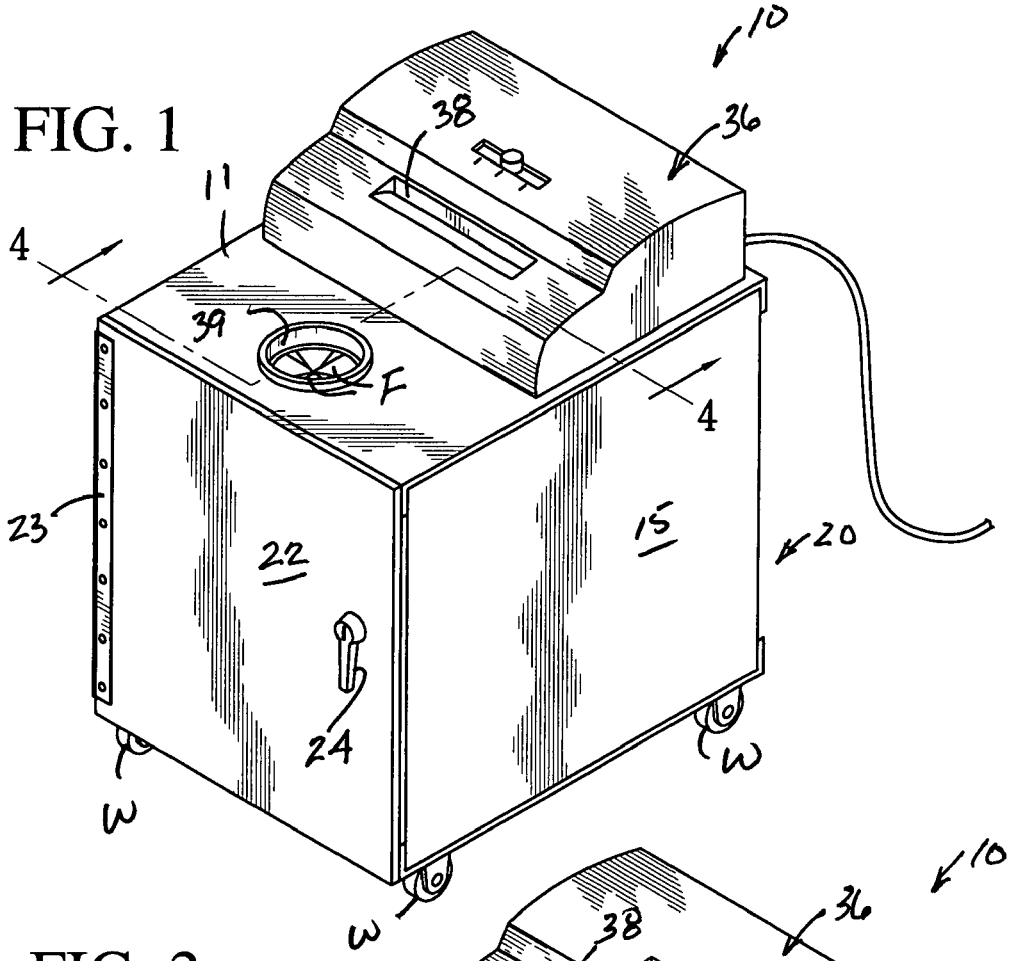
FIG. 1 is a perspective view of a machine for shredding/collecting drugs and drug packaging, and illustrates a housing closed by a door and a top wall supporting a shredder and an opening closed by a flexible inlet guard.

A novel mobile machine or apparatus constructed in accordance with this invention for shredding and collecting drugs, pharmaceutical and medical products and packaging therefor in hospitals, hospital pharmacies, nursing homes, and the like incident to permanent disposal/destruction is illustrated in FIGS. 1 through 4 of the drawings and is generally designated by the reference numeral 10. The shredding/collecting machine 10 is intended to shred or collect virtually any type of ingestible pharmaceutical, drug and/or medical products, such as those specified earlier herein including, but not limited to, tablets, capsules, granules, tubes, ampules, plastic or glass pill bottles and/or caps, multiple unit and single unit dosing packages, including blister packages, and blister cards, and the like.

Figure 3:
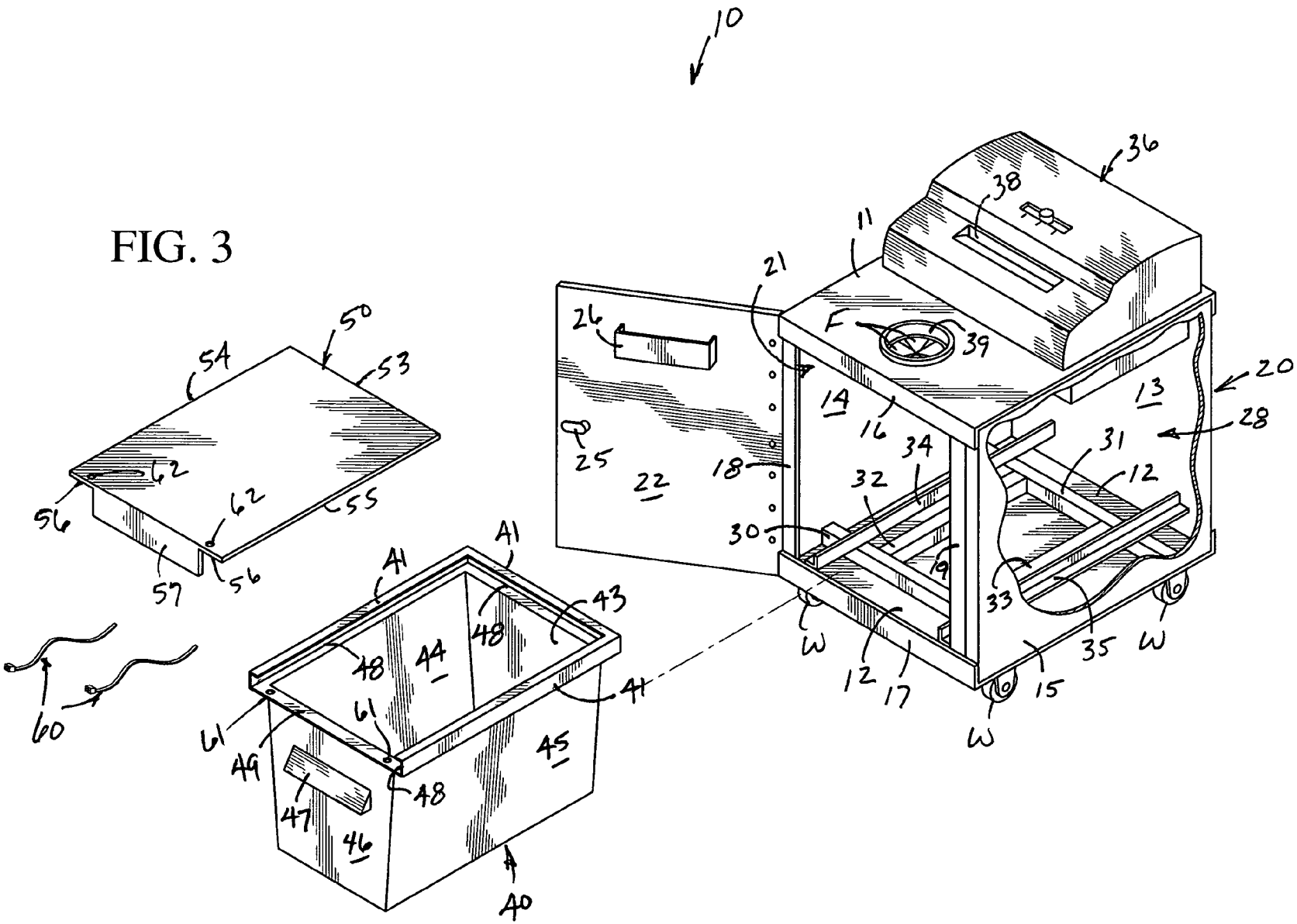
FIG. 3 is a perspective exploded view of the shredding and collecting machine of FIGS. 1 and 2 with a portion of the housing/cabinet broken away for clarity, and illustrates details of the container, cover or lid and two of the plastic locking ties.
Figure 5:
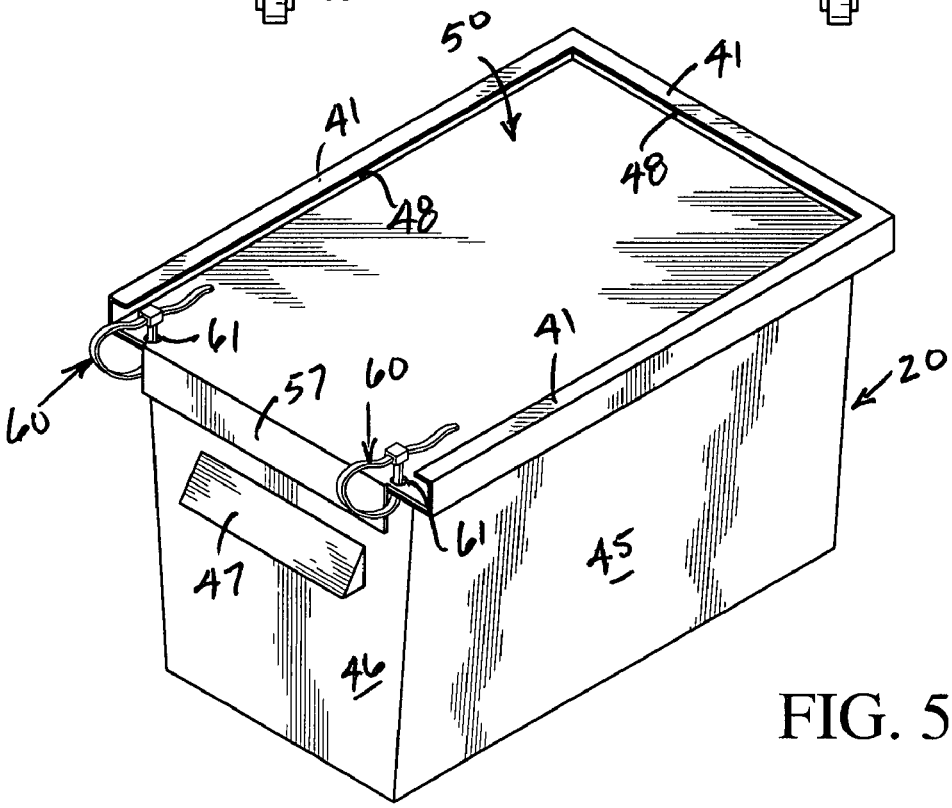
FIG. 5 is a perspective view of the container, and illustrates the lid closing the container and being secured thereto by the plastic locking ties passed through registered openings of the lid and a flange of the container.

The shredding and collecting machine includes a housing or cabinet 20, a container 40, a container lid 50 (FIGS. 3 and 5) and a plurality of plastic locking ties 60 (FIG. 3).

Figure 2:
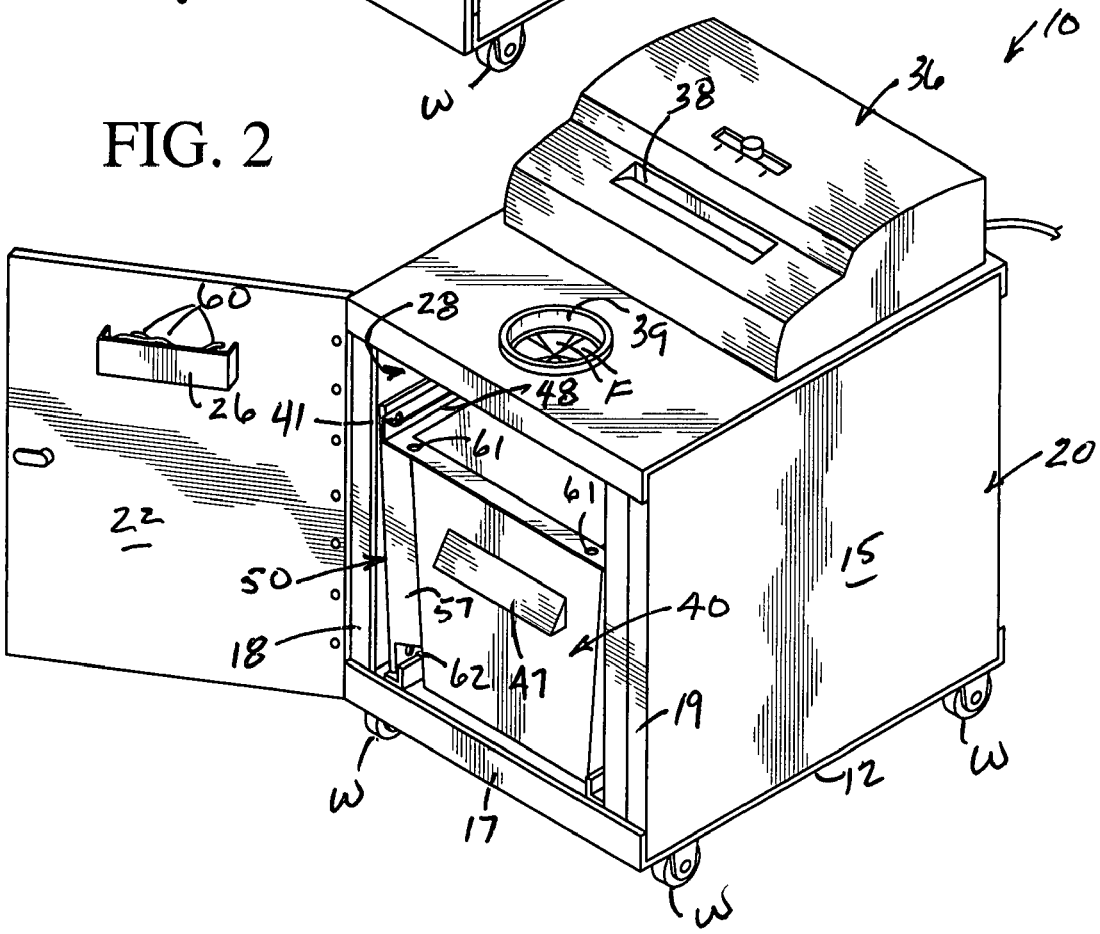
FIG. 2 is a perspective view substantially similar to FIG. 1, and illustrates the shredding/collecting machine with the front door open, a collection container and container lid housed within an interior chamber of the cabinet or housing, and a pocket on the door housing plastic locking ties.

The housing or cabinet 20 of the shredding or collecting machine 10 includes a top wall 11, a bottom wall 12 carrying wheels or casters W, a rear or back wall 13, side walls 14 and 15, upper and lower opposing front flanges 16, 17 and opposing front side flanges 18, 19, respectively, the latter flanges collectively defining a front opening 21. The opening 21 can be opened and closed by a front door 22 pivoted by a piano hinge 23 (FIG. 1) to the side flange 18 (FIG. 3). The front door 22 includes a lockable/unlockable handle 24 having an inner latch 25 which in the latched or locked position latches behind the front side flange 19. Means 26 in the form of a pocket is carried by the door 22 and housed therein are a plurality of the plastic locking ties 60 (FIGS. 2 and 3).

The door 22, the walls 11 through 15 and the flanges 16 through 19 define an interior chamber 28 (FIGS. 2 through 4) of the cabinet 20 into which the container 40 can be slidably inserted and removed in a manner to be described more fully hereinafter.

Figure 4:
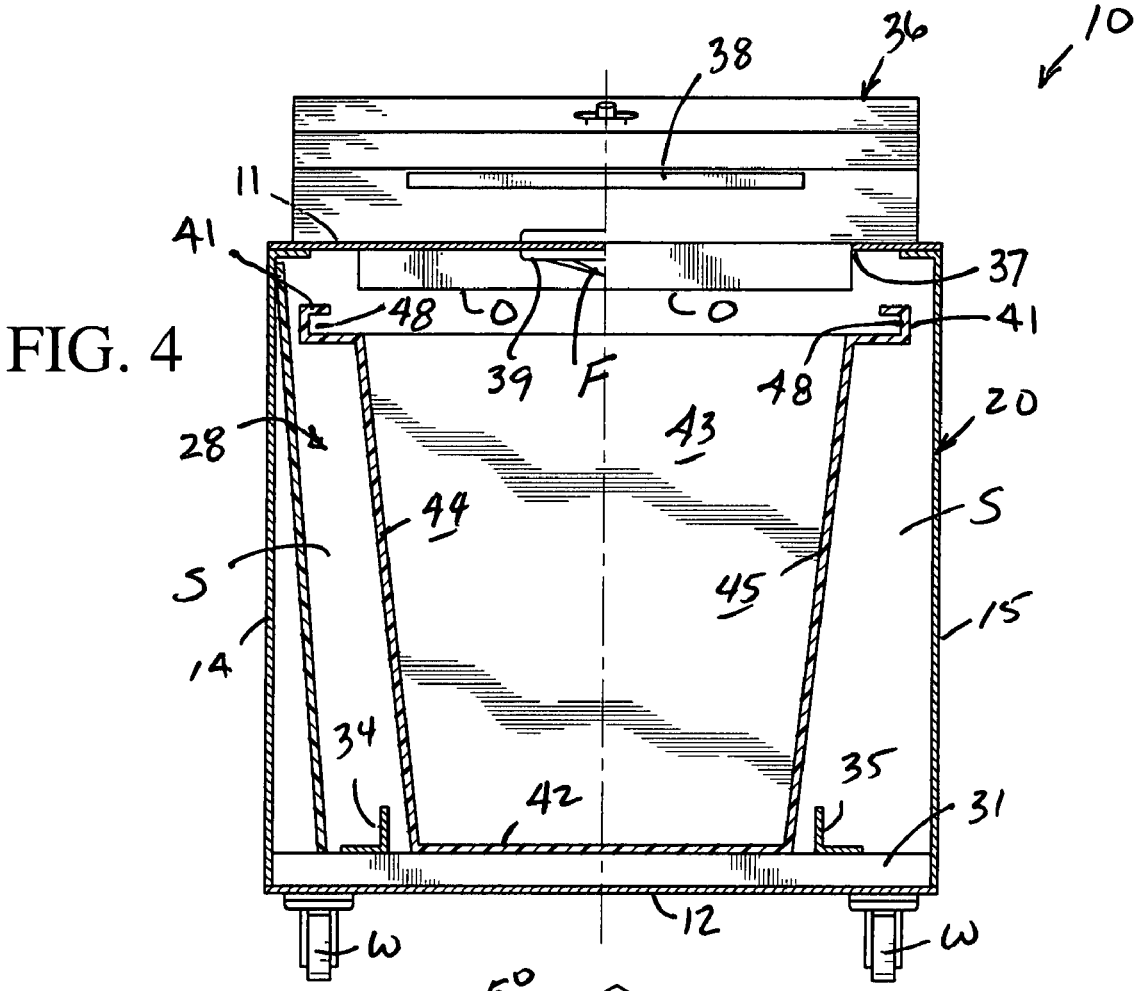
FIG. 4 is an enlarged cross-sectional view taken generally along line 4-4 of FIG. 1, and illustrates the location of the container and lid in the interior chamber of the cabinet.

The bottom wall 12 of the cabinet 20 is reinforced by spaced parallel tubes 30, 31 and similar spaced parallel tubes 32, 33, preferably welded to each other and welded to the bottom wall 12 (FIGS. 3 and 4). Similar tubing may be provided as necessary to reinforce any of the walls of the cabinet 20 should such be found necessary or desirable.

Means 34, 35 (FIGS. 3 and 4) each in the form of a generally L-angle iron member, define guide means for sliding the container 40 into and out of the interior chamber 28 of the cabinet 20. The guide means or guide rails 34, 35 are preferably welded to the tubes 30, 31 and the spacing therebetween corresponds substantially to the size of the width of a bottom wall 42 of the container 40, as is most readily apparent from FIG. 4 of the drawings.

Shredding means 36 (FIGS. 1 through 4) in the form of a conventional shredder is housed in a rectangular opening 37 (FIG. 4) of the top wall 11 and includes a feed slot 38. The shredder means or shredder 36 can correspond to any conventional shredder, such as the "Powershred® SB-97C Shredder CRC: 32197" manufactured by Fellowes www.fellowes.com) which includes an automatic feed and an active safety sensor that stops shredding immediately when the feed slot or product entry 36 is manually touched. For higher capacity and productivity, the shredder 36 may instead be the "Powershred® C-420 CRC: 384201.1," also manufactured by Fellowes.

Products or packaging which cannot be fed into the shredder 36 through the feed slot 38, such as glass or plastic bottles or caps, can be fed through a substantially circular feed opening 39 (FIGS. 1 through 4) which includes a plurality of radial slits defining a plurality of triangular radially inwardly directed flexible rubber or plastic flaps F typical of kitchen disposal openings.

The container 40 includes a top peripheral flange 41, the bottom wall 42, a rear wall 43, side walls 44 and 45 and a front wall 46 having a handle 47. The top peripheral flange is generally channel-shaped along the walls 43-45 with channels 48 of the walls 44, 45 being in opposing relationship to each other (FIGS. 3 and 4). The front wall 46 of the container 40 is devoid of a channel 48 and instead includes a radially outwardly directed flange 49 having holes 61 (FIGS. 2 and 3) at each of opposite ends or corners (unnumbered) thereof.

The cover or lid 50 (FIGS. 3 and 5) is generally rectangular or polygonal in configuration and includes a rear edge 53, side edges 54, 55 and at a front edge 56 a downwardly directed flange or handle 57. Openings 62, 62 are located at forward corners (unnumbered) of the lid 50 and the distance and location therebetween correspond to the distance and location of the openings 61, 61 of the flange 49 of the container 40.

Incident to performing a shredding or collecting operation utilizing the machine 10, the container 40 is inserted into the interior chamber 28 through the opening 21 by sliding the bottom wall 42 along the tubes 30-32 while being guided by the guide rails 34, 35 (FIG. 4). The container 40 is sized such that when fully inserted into the interior chamber 28, the top peripheral flange 41 along the back wall 43 contacts the back wall 13 of the cabinet 20 thereby accurately locating the container 40 beneath both an outlet O (FIG. 4) of the shredder 36 and the opening 39. The lid 50 is inserted into a storage area S (FIG. 4) located between the walls 14, 44 (or 15, 45) after which the front door 22 is closed and locked by the keyed lock or latch 25. Individual drug capsules, pills or the like or blister packages with pills still housed therein or any other conventional combination of ingestible drugs/pharmaceutical products which can be shredded by the shredder 36 are fed thereto through the feed slot 38, are conventionally shredded thereby and, upon exiting the shredder through the shredder outlet O (FIG. 4), accumulate in the interior of the container 40.

Other drugs/drug associated products and/or packaging which cannot be fed through the feed slot 38 of the shredder 36 or cannot be shredded thereby, such as glass or plastic pill bottles and caps, are simply pushed through the flexible flaps F of the opening 39 and dropped into the interior of the container 40. When the container 40 is filled to its desired capacity, which is conventionally sensed by the Fellows shredders heretofore described, the door 22 is unlocked, opened and the container 40 is withdrawn from the interior chamber 28 along with the lid 50. The lid 50 is then slid into the channel 48 in the manner readily apparent from a comparison of FIGS. 3 and 5, after which one of the plastic locking ties 60 (FIG. 3) is passed through the registered opening 61, 62; 61, 62 of the respective lid 50 and flange 49 of the container 40 and locked in the conventional manner illustrated in FIG. 5. As is well known in the prior art, such plastic locking ties 60 have teeth (not shown) which can pass through the locking tie opening (also not shown) in one direction but cannot be withdrawn from the latched position shown in FIG. 5. Therefore, if either or both of the plastic locking ties 60 have been broken or cut, such would reflect pilfering and thus serve as tamper-indicating means. The container 40 with the lid 50 locks thereto (FIG. 5) and the container contents are shipped to a conventional final disposal site conventionally available utilizing high volume, low speed, high torque shredding systems (See www.franklinmiller.com) which will shred the non-shred products deposited in the container 40 through the inlet opening 39. Alternatively, the container 40 is of a relatively small size (10 gallons) and when filled (FIG. 5), can be readily carried to a mobile shredding truck, such as the MS10 series manufactured by Franklin Miller Co., Inc. which is driven to the door of the hospital, pharmacy, nursing home or similar site utilizing the shredding and collecting machine 10.

Although a preferred embodiment of the invention has been specifically illustrated and described herein, it is to be understood that minor variations may be made in the apparatus without departing from the spirit and scope of the invention, as defined by the appended claims.

The invention claimed is:

1. A machine for shredding ingestible medical products comprising a housing defining an interior chamber, a container opening through which a container can be introduced into and withdrawn from said chamber, means for shredding ingestible medical products, said shredding means including an ingestible medical products entrance exteriorly of said interior chamber and a shredded ingestible medical products exit interiorly of said interior chamber, a container in said housing, said container having an upper opening, said container upper opening being disposed for receipt therethrough of shredded ingestible medical products incident to the shredding thereof by said shredding means and said container upper opening being bordered at least in part by a flange, means for introducing non-shredding medical products through said housing into said container through the opening thereof, and means for closing said container opening, means associated with said housing for storing a plurality of said fastening means, a plurality of means for fastening in said storage means, said container flange and closing means having registrable openings for receipt of at least one of said fastening means to fasten the same together, whereby both shredded and non-shredded products can be transported to an appropriate disposal site utilizing the closed container.

2. The machine as defined in claim 1 including means defined at least in part by said container and housing for establishing a storage volume of a size to accommodate said closing means when said container is located within said interior chamber.

3. The machine as defined in claim 2 wherein said non-shredded medical products introducing means is an opening in said housing disposed for the introduction of non-shredded medical products into said container through the opening thereof.

4. The machine as defined in claim 2 wherein said non-shredded medical products introducing means is an opening in said housing disposed for the introduction of non-shredded medical products into said container through the opening thereof, and flexible means for automatically closing said non-shredded medical products opening while being deflectable to permit entry therethrough of non-shredded medical products.

5. The machine as defined in claim 1 wherein said fastening means comprises a plastic locking tie.

6. The machine as defined in claim 1 wherein said non-shredded medical products introducing means is an opening in said housing disposed for the introduction of non-shredded medical products into said container through the opening thereof.

7. The machine as defined in claim 1 wherein said non-shredded medical products introducing means is an opening in said housing disposed for the introduction of non-shredded medical products into said container through the opening thereof and flexible means for automatically closing said non-shredded medical products opening while being deflectable to permit entry therethrough of non-shredded medical products.

8. The machine as defined in claim 1 wherein said housing includes a top panel, and said shredding means entrance and said non-shredded medical products opening are located contiguous said top panel.

9. The machine as defined in claim 1 including means in said housing for guiding slidable entry and exit of said container relative to said interior chamber.

10. The machine as defined in claim 1 wherein said container opening is defined at least in part by a flange, said closing means is a cover of a peripheral size and shape corresponding to said container opening, and means for fastening said cover to said container flange incident to the transport thereof to an appropriate disposal site.

11. The machine as defined in claim 1 wherein said non-shredded medical products introducing means is an opening in said housing disposed for the introduction of non-shredded medical products into said container through the opening thereof.

12. The machine as defined in claim 1 wherein said non-shredded medical products introducing means is an opening in said housing disposed for the introduction of non-shredded medical products into said container through the opening thereof, and flexible means for automatically closing said non-shredded medical products opening while being deflectable to permit entry therethrough of non-shredded medical products.

13. A machine for shredding ingestible medical products comprising a housing defined by top and bottom walls and a peripheral wall therebetween collectively defining an interior chamber, an opening for introducing a container into the interior chamber and removing therefrom in a direction substantially transverse to said peripheral wall, a door, means for pivoting said door between open and closed positions relative to said container introducing and removing opening, said container having an upper opening bordered at least in part by a flange, a cover for closing said container upper opening, said container and peripheral wall at least in part defining a cover storage volume of a size and shape to accommodate said cover when said container is housed within said interior chamber, means for shredding ingestible medical products, said shredding means including an ingestible medical products entrance exteriorly of said interior chamber contiguous said top wall and a shredded ingestible medical products exit interiorly of said interior chamber contiguous said container opening, means for introducing non-shredded medical products through said top wall into said container through the opening thereof, storage means for storing a plurality of fasteners, a plurality of fasteners in said fastener storage means, said container peripheral flange and cover having registrable openings for receipt of at least one of said fasteners for fastening the same together incident to effecting transport to an appropriate disposal side, and said non-shredded medical products opening being closed by at least one relatively flexible and deflectable flap to permit entry therethrough of non-shredded medical products.

14. The machine as defined in claim 13 including means for locking and unlocking said door.

15. The machine as defined in claim 13 including means for rollingly supporting said housing relative to a supporting surface.

16. The machine as defined in claim 14 including means in said housing for guiding slidable entry and exit of said container relative to said interior chamber.

17. The machine as defined in claim 15 including means in said housing for guiding slidable entry and exit of said container relative to said interior chamber.

18. The machine as defined in claim 16 including means for rollingly supporting said housing relative to a supporting surface.

* * * * *